US010262777B2

(12) United States Patent
Francke et al.

(10) Patent No.: US 10,262,777 B2
(45) Date of Patent: Apr. 16, 2019

(54) COMPOUND HAVING EXPONENTIAL TEMPERATURE DEPENDENT ELECTRICAL RESISTIVITY, USE OF SUCH COMPOUND IN A SELF-REGULATING HEATING ELEMENT, SELF-REGULATING HEATING ELEMENT COMPRISING SUCH COMPOUND, AND METHOD OF FORMING SUCH COMPOUND

(71) Applicant: Conflux AB, Järfälla (SE)

(72) Inventors: Tom Francke, Sollentuna (SE); Gunnar Nyberg, Täby (SE)

(73) Assignee: Conflux AB, Järfalla (SE)

( * ) Notice: Subject to any disclaimer, the term of this patent is extended or adjusted under 35 U.S.C. 154(b) by 216 days.

(21) Appl. No.: 15/031,327

(22) PCT Filed: Dec. 2, 2014

(86) PCT No.: PCT/SE2014/051434
§ 371 (c)(1),
(2) Date: Apr. 22, 2016

(87) PCT Pub. No.: WO2015/084241
PCT Pub. Date: Jun. 11, 2015

(65) Prior Publication Data

US 2016/0260529 A1 Sep. 8, 2016

(30) Foreign Application Priority Data

Dec. 2, 2013 (SE) ..... 1351428

(51) Int. Cl.
*H05B 1/02* (2006.01)
*H01C 7/00* (2006.01)
(Continued)

(52) U.S. Cl.
CPC ..... *H01C 7/008* (2013.01); *H01C 7/027* (2013.01); *H01C 17/0652* (2013.01);
(Continued)

(58) Field of Classification Search
CPC ..... H01C 7/08; H01C 7/027; H01C 17/0652; H01C 17/06586; H05B 3/0014;
(Continued)

(56) References Cited

U.S. PATENT DOCUMENTS 4,884,163 A 11/1989 Deep et al.
5,770,216 A * 6/1998 Mitchnick ..... C01G 9/02 428/402

(Continued)

FOREIGN PATENT DOCUMENTS

EP 0 512 703 A1 11/1992
JP 2002241554 8/2002

OTHER PUBLICATIONS

International Search Report for PCT/SE2014/051434 dated Mar. 9, 2015.

(Continued)

*Primary Examiner* — Mark Paschall
(74) *Attorney, Agent, or Firm* — Myers Bigel, P.A.

(57) ABSTRACT

A novel compound having exponential temperature dependent electrical resistivity comprises an electrically insulating bulk material (11), electrically conductive particles (12) of a first kind, and electrically conductive particles (13) of a second kind covered by a lubricant. The bulk material holds the particles of the first and second kinds in place therein; the particles of the second kind are smaller than the particles of the first kind; the particles of the second kind are more in number than the particles of the first kind; and the particles of the second kind have higher surface roughness than the particles of the first kind, wherein the particles of the second
(Continued)

kind comprise tips (13*a*) and the particles of the first kind comprise even surface portions (12*a*). The particles of the first and second kinds are arranged to form a plurality of current paths (14) through the compound, wherein each of the current paths comprises galvanically connected particles of the first and second kinds and a gap (14*a*) between a tip (13*a*) of one of the particles of the second kind and an even surface portion (12*a*) of one of the particles of the first kind, which gap is narrow enough to allow electrons to tunnel through the gap via the quantum tunneling effect. The bulk material has a thermal expansion capability such that it expands with temperature, thereby increasing the gap widths (w) of the current paths, which in turn increases the electrical resistivity of the compound exponentially.

37 Claims, 3 Drawing Sheets

(51) Int. Cl.

| | |
|---|---|
| ***H01C 7/02*** | (2006.01) |
| ***H01C 17/065*** | (2006.01) |
| ***H05B 3/14*** | (2006.01) |
| ***H05B 3/34*** | (2006.01) |
| ***H05B 3/00*** | (2006.01) |
| ***H05B 3/16*** | (2006.01) |

(52) U.S. Cl.
CPC ..... *H01C 17/06586* (2013.01); *H05B 3/0014* (2013.01); *H05B 3/145* (2013.01); *H05B 3/16* (2013.01); *H05B 3/34* (2013.01); *H05B 2203/009* (2013.01); *H05B 2203/017* (2013.01); *H05B 2203/02* (2013.01)

(58) Field of Classification Search
CPC ..... H05B 3/145; H05B 3/16; H05B 3/34; H05B 2203/009; H05B 2203/017; H05B 2203/02
USPC ..... 219/543, 505, 504, 548
See application file for complete search history.

(56) References Cited

U.S. PATENT DOCUMENTS

| | | | | |
|---|---|---|---|---|
| 5,902,518 | A | 5/1999 | Khazai et al. | |
| 6,091,052 | A * | 7/2000 | Matsuo | G03G 15/2039 126/263.01 |
| 9,815,114 | B2 * | 11/2017 | Kondoh | B22F 1/0059 |
| 2005/0218380 | A1 * | 10/2005 | Gramespacher | B82Y 30/00 252/500 |

OTHER PUBLICATIONS

Written Opinion of the International Searching Authonty for PCT/SE2014/051434 dated Mar. 9, 2015.

* cited by examiner

COMPOUND HAVING EXPONENTIAL TEMPERATURE DEPENDENT ELECTRICAL RESISTIVITY, USE OF SUCH COMPOUND IN A SELF-REGULATING HEATING ELEMENT, SELF-REGULATING HEATING ELEMENT COMPRISING SUCH COMPOUND, AND METHOD OF FORMING SUCH COMPOUND

STATEMENT OF PRIORITY

This application is a 35 U.S.C. § 371 national phase application of PCT Application No. PCT/SE2014/051434 filed Dec. 2, 2014, which claims priority to Swedish Application No. 1351428-6 filed Dec. 2, 2013, the entire contents of each of which is incorporated by reference herein.

TECHNICAL FIELD

The technical field is generally directed to a new compound having exponential temperature dependent electrical conductivity.

DESCRIPTION OF RELATED ART AND BACKGROUND

Materials having a positive temperature coefficient (PTC) experience an increase in electrical resistance when their temperature is raised. Materials which have useful engineering applications usually show a relatively rapid increase with temperature, i.e. a higher coefficient. The higher the coefficient, the greater an increase in electrical resistance for a given temperature increase.

PTC ceramics are known in the art. Most ceramics have a negative coefficient, whereas most metals have positive values. While metals do become slightly more resistant at higher temperatures, the PTC ceramics (often barium titanate and lead titanate composites) have a highly nonlinear thermal response, so that it becomes extremely resistive above a composition-dependent threshold temperature. This behavior causes the material to act as its own thermostat, since the material conducts current below a certain temperature, and does essentially not conduct current above a certain temperature.

SUMMARY

There are constantly demands for new PTC materials, which have improved electrical and mechanical performance, and which can be used in existing applications as well as new applications, in which present PTC materials are unsuitable.

A first aspect refers to a novel compound having exponential temperature dependent electrical resistivity, preferably exponentially increasing resistivity (or exponentially decreasing conductivity) with temperature. Such compound may be referred to as a novel PTC material.

The novel compound comprises an electrically insulating bulk material, electrically conductive particles of a first kind, and electrically conductive particles of a second kind. The bulk material holds the particles of the first and second kinds in place therein; the particles of the second kind are smaller than the particles of the first kind; the particles of the second kind are more in number than the particles of the first kind; and the particles of the second kind have higher surface roughness than the particles of the first kind, wherein the particles of the second kind comprise tips and the particles of the first kind comprise even surface portions. The particles of the first and second kinds are arranged to form a plurality of current paths through the compound, wherein each of the current paths comprises galvanically connected particles of the first and second kinds and a gap between a tip of one of the particles of the second kind and an even surface portion of one of the particles of the first kind, which gap is narrow enough, e.g. less than 100 nm, to allow electrons to tunnel through the gap via the quantum tunneling effect. The bulk material has a thermal expansion capability such that it expands with temperature, thereby increasing the gap widths of the current paths, which in turn increases the electrical resistivity of the compound exponentially. At a certain gap width of the current paths, the quantum tunneling effect disappears and the compound does not conduct any longer.

The bulk material may comprise a cross-linked polymer or elastomer, such as for example a silicone, e.g. polydimethyl siloxane, and the particles of the first and second kinds may be carbon-containing particles, such as for example carbon blacks. The bulk material may also comprise a filler, thickener, or stabilizer, such as for example silica.

The particles of the second kind may have a size which is at least 5 times, preferably at least 10 times, more preferably at least 50 times, and most preferably at least 500 times smaller than a size of the particles of the first kind, wherein the sizes are volume based or weight based particle sizes. The sizes may be statistically determined sizes, such as e.g. median sizes or average sizes, of the particles of the first and second kinds.

The number of particles of the second kind may be at least 5 times, preferably at least 10 times, more preferably at least 50 times, and most preferably at least 500 times more than the number of the particles of the first kind.

The particles of the second kind may have at least 5 times, preferably at least 10 times, more preferably at least 50 times, and most preferably at least 500 times higher surface roughness than the particles of the first kind, wherein the surface roughness is measured as any of the arithmetic average of absolute values, root mean squared, maximum valley depth, maximum peak height, maximum height of the profile, skewness, kurtosis, average distance between the highest peak and lowest valley in each sampling length, or Japanese Industrial Standard based on the five highest peaks and lowest valleys over the entire sampling length.

The particles of the second kind may have highly irregular shape and tips, which are so sharp that the very ends of the tips comprise a single atom or a few atoms only, whereas the electrically conducting particles of the first kind have a more regular shape.

The bulk material may have a linear or volumetric thermal expansion coefficient of at least $50\times10^{-6}$ $K^{-1}$, preferably at least $100\times10^{-6}$ $K^{-1}$, and more preferably at least $200\times10^{-6}$ $K^{-1}$.

A second aspect refers to the use of the novel compound as a self-regulated heating element.

A third aspect refers to a self-regulating heating element comprising the novel compound and two terminals electrically connected thereto. The compound may be provided in the form of a layer and the two terminals may comprise each a patterned electrically conducting layer. In one embodiment the patterned electrically conducting layers are formed on opposite sides of the compound layer, and in another embodiment the patterned electrically conducting layers are formed on a single side of the compound layer, wherein a protective layer is formed on the side of the compound layer, which is opposite to the side, on which the patterned electrically conducting layers are formed.

A fourth aspect refers to a method of forming a novel compound having exponential temperature dependent electrical resistivity. According to the method, an electrically insulating bulk material being capable of holding particles in place therein and having a thermal expansion capability such that it expands with temperature is provided; and electrically conductive particles of a first kind and electrically conductive particles of a second kind are provided, wherein the particles of the second kind (i) are smaller than the particles of the first kind; (ii) are more in number than the particles of the first kind, and (iii) have higher surface roughness than the electrically conducting particles of the first kind; and the particles of the second kind comprise tips and the particles of the first kind comprise even surface portions.

The particles of the first and second kinds are arranged in the bulk material to form a plurality of current paths through the compound, wherein each of the current paths comprises galvanically connected particles of the first and second kinds and a gap between a tip of one of the electrically conducting particles of the second kind and an even surface portion of one of the electrically conducting particles of the first kind, which gap is narrow enough, e.g. less than 100 nm, to allow electrons to tunnel through the gap via the quantum tunneling effect.

Hereby, the electrical resistivity of the compound is exponentially increasing with the temperature.

The bulk material may be a polymer or elastomer, such as for example a silicone, e.g. polydimethyl siloxane, as disclosed above. The polymer or elastomer is cross-linked or hardened after that the electrically conducting particles of the first and second kinds have been arranged in the electrically insulating bulk material. The cross-linking may be performed by irradiating the compound with electrons, by platinum-catalyzed curing, by vulcanization, or by any other method.

The particles of the first and second kinds may be carbon-containing particles, such as for example carbon blacks, wherein the particles of the second kind may have highly irregular shape and tips, which may be so sharp that the very ends of the tips comprise a single atom or a few atoms only, whereas the particles of the first kind may have more regular shape.

The surface of the particles of the second kind may be covered by a lubricant, such as for example a homo-oligomer, e.g. vinylmethoxysiloxane homo-oligomer, before the particles of the first and second kinds are arranged in the bulk material, and a filler, thickener, or stabilizer, such as for example silica, may be mixed with the bulk material to obtain a compound having a desired consistence and flexibility. The use of the lubricant is important in order to have the particles of the first and second kinds appropriately arranged in the bulk material to form the desired current paths.

The number of the current paths through the compound and the widths of the gaps therein at any given temperature are provided depending on the thermal expansion capability of the electrically insulating bulk material to obtain an exponential temperature dependent electrical resistivity of the compound in a selected temperature interval and optionally to obtain a non-conducting compound above a selected temperature (at which temperature, the gaps are wide enough to not allow electrons to tunnel through the gap via the quantum tunneling effect).

Advantages of the novel compound include the following:

- The novel compound has an exponentially increasing electrical resistivity with temperature within a desired temperature interval
- The desired temperature interval can be selected by adjusting the compound to temperatures which fit a variety of applications
- The novel compound can be switched from an electrically conducting state to an electrically non-conducting state by increasing its temperature above a selected temperature, at which no electrons are allowed to tunnel via the quantum tunneling effect, thereby creating conduction paths for electrons through the compound
- The novel compound can be made in flexible and bendable thin films, which may then be cut to fit a variety of applications
- The novel compound is made of common materials, which are not expensive
- The novel compound can be used in self-regulating heating elements
- Such self-regulating heating elements are efficient, reliable, accurate, and robust, and occupy small space Further characteristics and advantages will be evident from the detailed description of embodiments given hereinafter, and the accompanying FIGS. 1-6, which are given by way of illustration only.

DETAILED DESCRIPTION OF EMBODIMENTS

Figure 1:
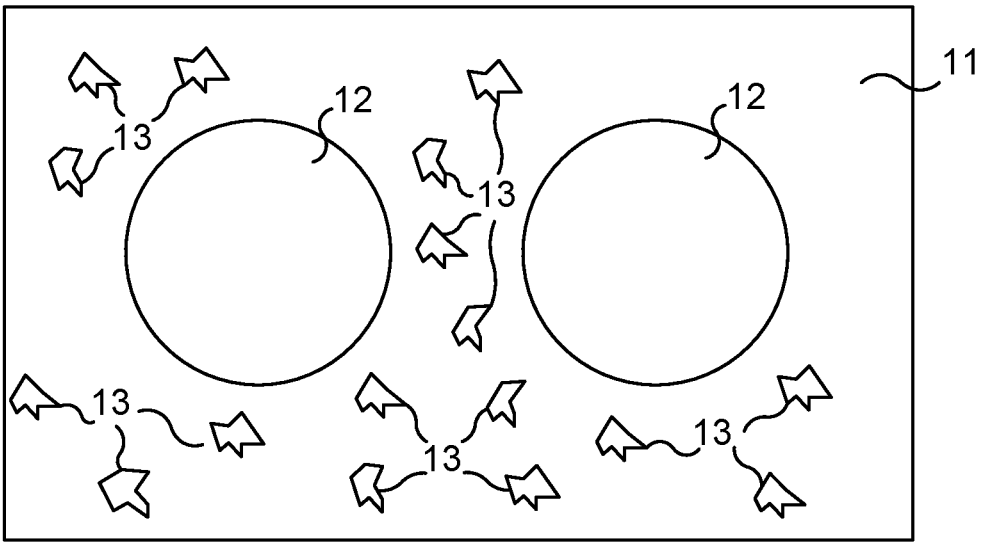
FIG. 1 illustrates schematically a portion of a compound having exponential temperature dependent electrical resistivity according to an embodiment.

FIG. 1 illustrates schematically a portion of a compound having exponential temperature dependent electrical resistivity according to an embodiment.

The compound comprises an electrically insulating bulk material 11, electrically conductive particles 12 of a first kind, and electrically conductive particles 13 of a second kind arranged in the bulk material 11.

The bulk material 11 may comprise an amorphous cross-linked polymer or elastomer, such as for example a siloxane elastomer (often called silicone elastomer) such as polyfluorosiloxane or polydimethyl siloxane and possibly also a filler, thickener, or stabilizer.

The bulk material holds the particles of the first and second kinds firmly in place in the bulk material.

The filler, thickener, or stabilizer may be mixed with the bulk material to obtain a compound having a desired consistence, flexibility, and/or elasticity.

The electrically conducting particles 12, 13 of the first and second kinds may be carbon-containing particles, such as for example carbon blacks.

The particles 13 of the second kind may (i) be smaller, (ii) be more in number, (iii) have higher surface roughness, and (iv) have more irregular shape than the particles 12 of the first kind as being schematically illustrated in FIG. 1.

More in detail, the particles 13 of the second kind may have a size which is at least 5 times, preferably at least 10 times, more preferably at least 50 times, and most preferably at least 500 times smaller than a size of the particles 12 of the first kind, wherein the sizes are volume based or weight based particle sizes. The sizes may be statistically determined sizes, such as e.g. median sizes or average sizes, of the particles of the first and second kinds.

In one example the particles may have the following average size (given in nm):

| | |
|---|---|
| Particles of the first kind | 500 |
| Particles of the second kind | 50 |

It shall be appreciated that the individual sizes of the particles of each kind may vary quite much, such as e.g. by a factor 10. Therefore it is advantageous that the sizes are given as some kind of statistical sizes, such as e.g. average sizes.

The number of g particles 13 of the second kind may be at least 5 times, preferably at least 10 times, more preferably at least 50 times, and most preferably at least 500 times more than the number of the particles 12 of the first kind.

The particles 13 of the second kind may have at least 5 times, preferably at least 10 times, more preferably at least 50 times, and most preferably at least 500 times higher surface roughness than the particles 12 of the first kind, wherein the surface roughness is measured as any of the arithmetic average of absolute values, root mean squared, maximum valley depth, maximum peak height, maximum height of the profile, skewness, kurtosis, average distance between the highest peak and lowest valley in each sampling length, or Japanese Industrial Standard based on the five highest peaks and lowest valleys over the entire sampling length.

The particles 13 of the second kind may have highly irregular shape, whereas the particles 12 of the first kind may have regular shape.

The particles 12, 13 of the first and second kinds may have different properties with respect to surface energies and electrical conductivities.

Figure 2:
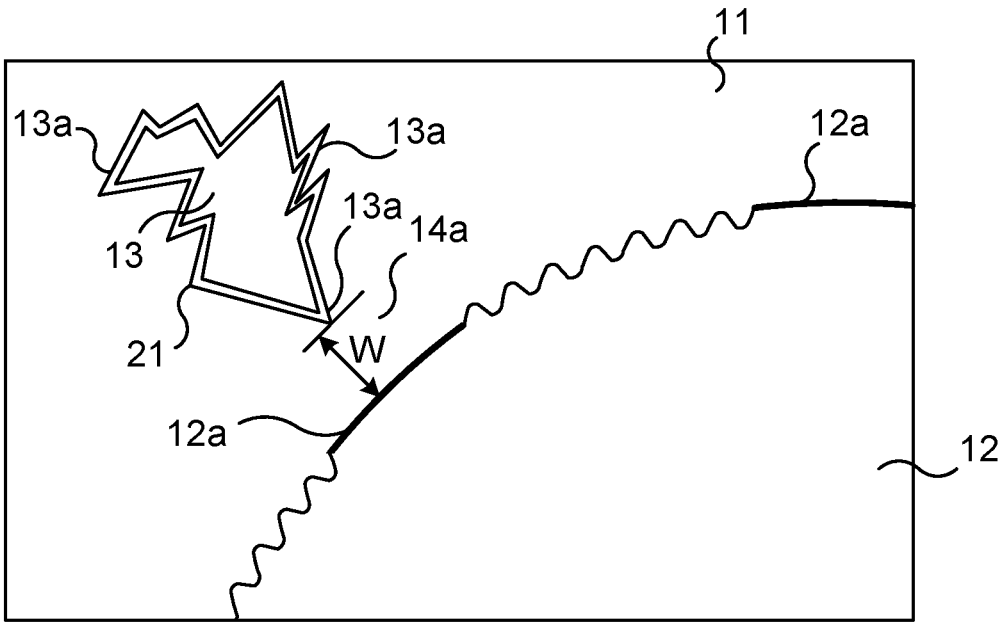
FIG. 2 illustrates schematically a detail of the structure of the compound in FIG. 1 in more detail.

FIG. 2 illustrates schematically a detail of the structure of the compound in FIG. 1 in more detail including one particle 13 of the second kind and a portion of one particle 12 of the first kind firmly secured in the bulk material 11.

It can be seen that the highly irregularly shaped particles 13 of the second kind comprise tips 13*a* and the more regularly shaped particles 12 of the first kind comprise even surface portions 12*a*. The tips 13*a* of the particles 13 of the second kind may be so sharp that the very ends of the tips 13*a* comprise a single atom or a few atoms only.

If the width w of a gap 14*a* between a tip 13*a* of one of the particles 13 of the second kind and an even surface portion 12*a* of one of particles 12 of the first kind is narrow enough, electrons are enabled to tunnel through the gap via the quantum tunneling effect.

In one embodiment, the surface of the particles 13 of the second kind may be covered by a lubricant, such as for example a homo-oligomer, e.g. vinylmethoxysiloxane homo-oligomer, as being illustrated for one of the particles 13 of the second kind in FIG. 2. The lubricant 21 may assist in a suitable positioning of the particles 13 of the second kind in the bulk material 11. The lubricant 21 may be formed as a layer on the surface of the particles 13 of the second kind. The entire surface, or at least a major portion of the surface, of the surface of the particles 13 of the second kind is covered by the lubricant 21. The use of the lubricant 21 is important in order to have the particles 12, 13 of the first and second kinds appropriately arranged in the bulk material 11 to form the desired current paths 14.

Figure 3:
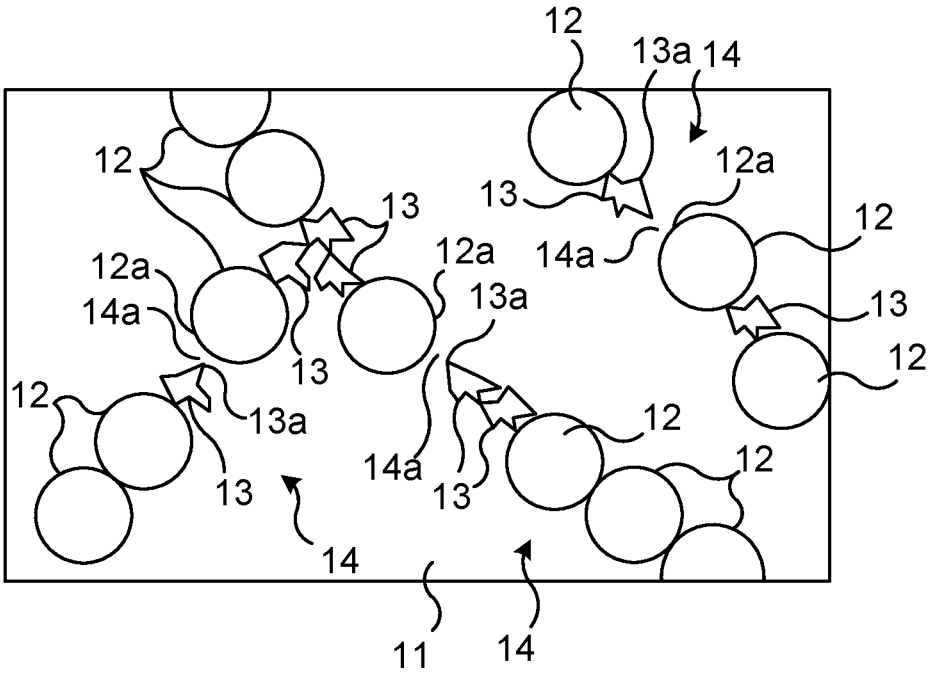
FIG. 3 illustrates schematically a portion of the compound in FIG. 1, wherein a plurality of current paths through the compound is shown.

FIG. 3 illustrates schematically a portion of the compound in FIG. 1, wherein a plurality of current paths 14 through the compound is shown. The particles 12, 13 of the first and second kinds are arranged to form the current paths 14 through the compound, wherein each of the current paths 14 comprises galvanically connected particles 12, 13 of the first and second kinds and a gap 14*a* between a tip 13*a* of one of the particles 13 of the second kind and an even surface portion 12*a* of one of the particles 12 of the first kind, wherein the gap 14*a* has a width which is small enough, e.g. less than 100 nm, to allow electrons to tunnel through the gap via the quantum tunneling effect. While, FIG. 3 illustrates three current paths through the compound, it shall be appreciated that there may be thousands of current paths per square millimeter through a film of the compound. At a certain gap width w of the current paths, the quantum tunneling effect disappears and the compound does not conduct any longer.

The bulk material 11 has a thermal expansion capability such that it expands with temperature, thereby increasing the gap widths w of the current paths 14, which in turn increases the electrical resistivity of the compound exponentially. As a non-limiting example, the bulk material 11 may have a linear or volumetric thermal expansion coefficient of at least $50\times10^{-6}$ $K^{-1}$, preferably at least $100\times10^{-6}$ $K^{-1}$, and more preferably at least $200\times10^{-6}$ $K^{-1}$.

The number of the current paths 14 through the compound and the widths w of the gaps therein at any given temperature are provided depending on the thermal expansion capability of the bulk material 11 to obtain an exponential temperature dependent electrical resistivity of the compound in a selected temperature interval.

The number of current paths is obtained by suitable densities of the particles 12, 13 of the first and second kinds. The selected temperature interval depends on the application, for which the compound is to be used, but may be in the interval −20° C. to 170° C.

The novel compound may be provided as a thin film having a thickness of e.g. about 0.1-1 mm.

The compound disclosed above may be used as a self-regulated heating element, wherein no thermostat is required. When using the compound as a heating element, a current is flown through the compound, and heat generated proportional to the resistance of the compound and proportional to the square of the current flown through the compound. As the temperature is increased the resistivity is increased exponentially with temperature, which means that the resistance is increased exponentially with temperature causing the compound to become essentially non-conduction, and the heating element is turned off automatically.

Figure 4:
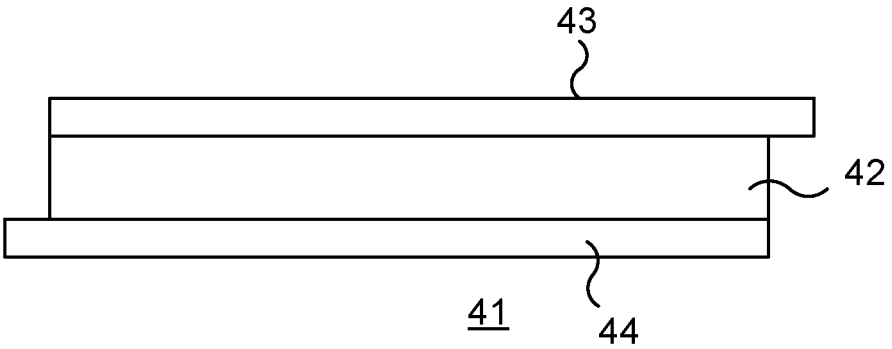
FIG. 4 illustrates schematically, in a side view, a self-regulating heating element according to an embodiment.

FIG. 4 illustrates schematically, in a side view, a self-regulating heating element 41 according to an embodiment. The heating element 41 comprises a film 42 of the novel compound and two terminals 43, 44 electrically connected thereto. The two terminals 43, 44 comprise each a patterned electrically conducting layer, wherein the patterned electrically conducting layers are formed on opposite sides of the compound layer 42.

By way of example, the electrically conducting layers may be about 0.01-0.1 mm thick and may be covered by electrically insulating protective films, e.g. plastic films.

Figure 5:
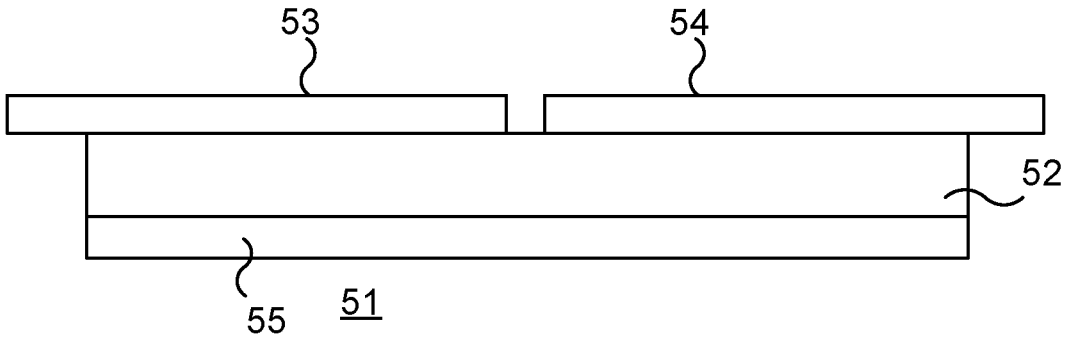
FIG. 5 illustrates schematically, in a side view, a self-regulating heating element according to an embodiment.

FIG. 5 illustrates schematically, in a side view, a self-regulating heating element 51 according to another embodiment. The heating element 51 comprises a film 52 of the novel compound and two terminals 53, 54 electrically connected thereto. The two terminals 53, 54 comprise each a patterned electrically conducting layer, wherein the patterned electrically conducting layers are formed on a single side of the compound layer 52. A protective layer 55 e.g. made of plastic may be formed on the side of the compound layer 52, which is opposite to the side, on which the patterned electrically conducting layers are formed.

The heating elements disclosed with reference to FIGS. 4 and 5 can be tailor made for different applications, and be manufactured on demand from intermediately stored films of the novel compound. They may be flexible and bendable so they can be arranged on non-planar surfaces.

Figure 6:
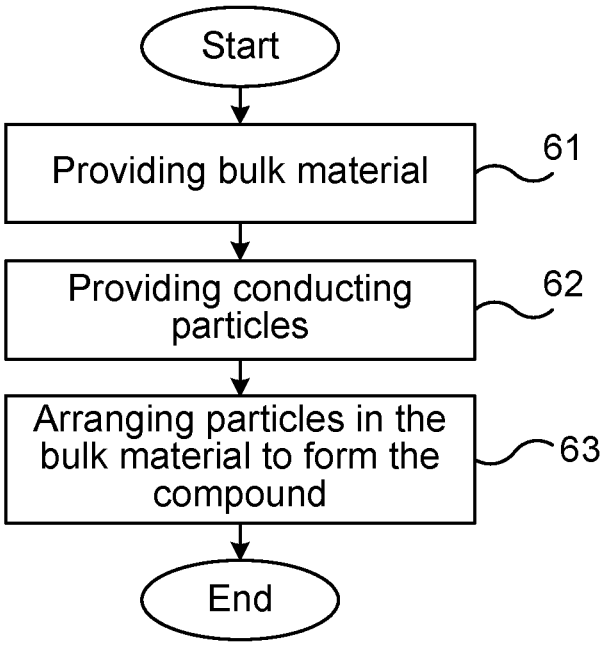
FIG. 6 illustrates schematically in a flow chart a method of forming a compound having exponential temperature dependent electrical resistivity according to an embodiment.

FIG. 6 illustrates schematically in a flow chart a method of forming a compound having exponential temperature dependent electrical resistivity according to an embodiment.

An electrically insulating bulk material is, in a step 61, provided. The bulk material is capable of holding particles in place therein and has a thermal expansion capability such that it expands with temperature.

Electrically conductive particles of a first kind and electrically conductive particles of a second kind are, in a step 62, provided, wherein (a) the particles of the second kind (i) are smaller than the particles of the first kind; (ii) are more in number than the particles of the first kind, and (iii) have higher surface roughness than the particles of the first kind; and (b) the particles of the second kind comprise tips 13*a* and the particles of the first kind comprise even surface portions.

The particles of the first and second kinds are, in a step 63, arranged in the bulk material to form a plurality of current paths through the compound, wherein each of the current paths comprises galvanically connected particles of the first and second kinds and a gap between a tip of one of the electrically conducting particles of the second kind and an even surface portion of one of the electrically conducting particles of the first kind, and the gap has a width which is small enough to allow electrons to tunnel through the gap via the quantum tunneling effect.

The bulk material may comprise a polymer or elastomer, such as for example a silicone, e.g. polydimethyl siloxane, which may be cross-linked after that the particles of the first and second kinds have been arranged in the electrically insulating bulk material. The cross-linking may for instance be performed by irradiating the compound with electrons, by platinum-catalyzed curing, or by vulcanization.

A filler, thickener, or stabilizer, such as for example silica, may be mixed with the polymer or elastomer to obtain a compound having a desired consistence, flexibility, and/or elasticity.

The particles of the first and second kinds may be carbon-containing particles, such as for example carbon blacks, wherein the tips of the particles of the second kind may be so sharp that the very ends of the tips comprise a single atom or a few atoms only.

The particles of the second kind may be provided of a highly irregular shape, whereas the particles of the first kind may be provided of regular shape.

The particles of the first kind may be mixed with the polymer or elastomer.

The particles of the second kind may be covered by a lubricant, such as for example a homo-oligomer, e.g. vinylmethoxysiloxane homo-oligomer, before the particles of the first and second kinds are arranged in the bulk material. To this end, the particles of the second kind and the lubricant are mixed together in a solvent, after which the solvent is removed.

The mixture of the particles of the second kind and the lubricant may be mixed with the filler, thickener, or stabilizer in a solvent, after which the solvent is removed.

The mixture of the particles of the second kind, the lubricant and the filler, thickener, or stabilizer may be mixed with the mixture of the particles of the first kind and the polymer or elastomer to obtain the compound.

Alternatively, the filler, thickener, or stabilizer may be mixed with the particles of the first kind and/or the polymer or elastomer, to which the mixture of the particles of the second kind and the lubricant is added.

The number of the current paths through the compound and the widths of the gaps therein at any given temperature are provided depending on the thermal expansion capability of the compound to obtain an exponential temperature dependent electrical resistivity of the compound in a selected temperature interval.

The number of the current paths through the compound, the widths of the gaps therein, and the thermal expansion capability of the compound can be controlled by adjusting the various ingredients of the compound, varying the amounts of the various ingredients of the compound, varying the order and manner in which they are mixed, and/or varying the cross-linking of the polymer or elastomer comprised in the bulk material.

In one example the compound is made up the following ingredients and amounts thereof (as given in weight percentages based on the weight of the compound):

| | |
|---|---|
| polydimethyl siloxane | 44 |
| silica | 3 |
| carbon blacks of the first kind | 48 |
| carbon blacks of the second kind | 4.95 |
| vinylmethoxysiloxane homo-oligomer | 0.05 |

It shall be appreciated by a person skilled in the art that the above disclosed embodiments may be combined to form further embodiment falling within the terms of the claims, and that any measures are purely given as example measures.

The invention claimed is:

1. A compound having exponential temperature dependent electrical resistivity comprising an electrically insulating bulk material (11), electrically conductive particles (12) of a first kind, and electrically conductive particles (13) of a second kind, wherein the electrically insulating bulk material holds the electrically conducting particles of the first and second kinds in place in the electrically insulating bulk material;

the electrically conducting particles of the second kind are smaller than the electrically conducting particles of the first kind;

the electrically conducting particles of the second kind are present in a larger amount than the electrically conducting particles of the first kind;

the electrically conducting particles of the second kind have higher surface roughness than the electrically conducting particles of the first kind, wherein the electrically conducting particles of the second kind comprise tips (13*a*) and the electrically conducting particles of the first kind comprise even surface portions (12*a*);

the electrically conducting particles of the first and second kinds are arranged to form a plurality of current paths (14) through the compound, wherein each of said current paths comprises galvanically connected electrically conducting particles of the first and second kinds and a gap (14*a*) between a tip (13*a*) of one of the electrically conducting particles, of the second kind and an even surface portion (12*a*) of one of the electrically conducting particles of the first kind, which gap is narrow enough to allow electrons to tunnel through the gap via the quantum tunneling effect;

the electrically insulating bulk material has a thermal expansion capability such that it expands with temperature, thereby increasing the gap widths (w) of the current paths, which in turn increases the electrical resistivity of the compound exponentially; and said compound comprises a lubricant (21), wherein the surface of the electrically conducting particles of the second kind are covered by said lubricant.

2. The compound of claim 1 wherein the insulating bulk material comprises a cross-linked polymer or elastomer.

3. The compound of claim 1 wherein the electrically conducting particles of the first and second kinds are carbon-containing particles.

4. The compound of claim 1 wherein the electrically conducting particles of the second kind have a size which is at least 5 times, smaller than a size of the electrically conducting particles of the first kind.

5. The compound of claim 4 wherein the sizes are volume based particle sizes.

6. The compound of claim 4 wherein the sizes are weight based, particle sizes.

7. The compound of claim 4 wherein the sizes are statistically determined sizes of the electrically conducting particles of the first and second kinds.

8. The compound of claim 1 wherein the number of electrically conducting particles of the second kind are at least 5 times times more than the number of the electrically conducting particles of the first kind.

9. The compound of claim 1 wherein the electrically conducting particles of the second kind have at least 5 times higher surface roughness than the electrically conducting particles of the first kind, wherein the surface roughness is measured as any of the arithmetic average of absolute values, root mean squared, maximum valley depth, maximum arithmetic average of absolute values, root mean squared, maximum valley depth, maximum peak height, maximum height of the profile, skewness, kurtosis, average distance between the highest peak and lowest valley in each sampling length, or Japanese Industrial Standard based on the five highest peaks and lowest valleys over the entire sampling length.

10. The compound of claim 1 wherein the tips of the electrically conducting particles of the second kind comprise only a single atom or a few atoms at the very ends of the tips.

11. The compound of claim 1 wherein, for each of the current paths, the width of the gap is less than 100 nm.

12. The compound of claim 1 wherein the electrically conducting particles of the second kind have highly irregular shape.

13. The compound of claim 1 wherein the electrically conducting particles of the first kind have regular shape.

14. The compound of claim 1 wherein the electrically insulating bulk material has a linear or volumetric thermal expansion coefficient of at least $50\times10^{-6}$ $K^{-1}$.

15. The compound of claim 1 wherein the electrically insulating bulk material comprises a filler, thickener, or stabilizer, distributed in said compound.

16. The compound of claim 1 wherein the number of the current paths through the compound and, the widths of the gaps therein at any given temperature are provided depending on the thermal expansion capability of the electrically insulating bulk material to obtain the exponential temperature dependent electrical resistivity of the compound in a selected temperature interval.

17. A self-regulating heating element (41; 51) comprising the compound of claim 1 and two terminals electrically connected thereto (43, 44; 53, 54).

18. The self-regulating heating element of claim 17 wherein the compound is provided in the form of a layer (42) and wherein the two terminals comprise each a patterned electrically conducting layer (43, 44), wherein the patterned electrically conducting layers are formed on opposite sides of the compound layer.

19. The self-regulating heating element of claim 17 wherein the compound is provided in the form of a layer and wherein the two terminals comprise each a patterned electrically conducting layer (53, 54), wherein the patterned electrically conducting layers are formed on a single side of the compound layer.

20. The method of claim 1, wherein the lubricant comprises a homo-oligomer.

21. The method of claim 20, wherein the homo-oligomer is vinylmethoxysiloxane.

22. The compound of claim 2, wherein the insulating bulk material comprises a silicone.

23. The compound of claim 22, wherein the silicone is polydimethyl siloxane.

24. The compound of claim 3, wherein the carbon-containing particles are carbon blacks.

25. The compound of claim 4 wherein the electrically conducting particles of the second kind have a size which is at least 10 times smaller than a size of the electrically conducting particles of the first kind.

26. The compound of claim 4 wherein the electrically conducting particles of the second kind have a size which is at least 50 times smaller than a size of the electrically conducting particles of the first kind.

27. The compound of claim 4 wherein the electrically conducting particles of the second kind have a size which is at least 500 times smaller than a size of the electrically conducting particles of the first kind.

28. The compound of claim 7 wherein the statistically determined sizes are median sizes or average sizes of the electrically conducting particles of the first and second kinds.

29. The compound of claim 8 wherein the number of electrically conducting particles of the second kind are at least 10 times more than the number of the electrically conducting particles of the first kind.

30. The compound of claim 8 wherein the number of electrically conducting, particles of the second kind are at least 50 times more than the number of the electrically conducting particles of the first kind.

31. The compound of claim 8 wherein the number of electrically conducting particles of the second kind are at least 500 times more than the number of the electrically conducting particles of the first kind.

32. The compound of claim 9 wherein the electrically conducting particles of the second kind have at least 10 times higher surface roughness than the electrically conducting particles of the first kind.

33. The compound of claim 9 wherein the electrically conducting particles of the second kind have at least 50 times higher surface roughness than the electrically conducting particles of the first kind.

34. The compound of claim 9 wherein the electrically conducting particles of the second kind have at least 500 times higher surface roughness than the electrically conducting particles of the first kind.

35. The compound of claim 14 wherein the electrically insulating bulk material has a linear or volumetric thermal expansion coefficient of at least $100\times10^{-6}$ $K^{-1}$.

36. The compound of claim 14 wherein the electrically insulating hulk material has a linear or volumetric thermal expansion coefficient of at least $200\times10^{-6}$ $K^{-1}$.

37. The compound of claim 15 wherein the electrically insulating bulk material comprises silica distributed in said compound.

* * * * *